US006461452B1

(12) United States Patent
Kosa

(10) Patent No.: US 6,461,452 B1
(45) Date of Patent: Oct. 8, 2002

(54) FREE-MACHINING, MARTENSITIC, PRECIPITATION-HARDENABLE STAINLESS STEEL

(75) Inventor: Theodore Kosa, Reading, PA (US)

(73) Assignee: CRS Holdings, Inc., Wilmington, DE (US)

( * ) Notice: Subject to any disclaimer, the term of this patent is extended or adjusted under 35 U.S.C. 154(b) by 0 days.

(21) Appl. No.: 09/858,817

(22) Filed: May 16, 2001

(51) Int. Cl.[7] ..... C22C 38/48; C22C 38/60
(52) U.S. Cl. ..... 148/326; 148/325; 420/42
(58) Field of Search ..... 148/325, 326; 420/42

(56) References Cited

U.S. PATENT DOCUMENTS

| | | | | |
|---|---|---|---|---|
| 2,850,380 A | | 9/1958 | Clarke, Jr. | |
| 3,574,601 A | | 4/1971 | Myers et al. | |
| 4,769,213 A | * | 9/1988 | Haswell, Jr. et al. | 420/60 |
| 4,798,634 A | * | 1/1989 | McCune, III et al. | 148/325 |
| 5,427,635 A | * | 6/1995 | Bletton et al. | 148/325 |

* cited by examiner

*Primary Examiner*—Deborah Yee
(74) *Attorney, Agent, or Firm*—Dann, Dorfman, Herrell and Skillman, P.C.

(57) ABSTRACT

A free-machining, precipitation-hardenable, martensitic stainless steel is described that provides a unique combination of machinability, processability, and toughness. The broad compositional range of the steel alloy of the invention is as follows, in weight percent:

| | |
|---|---|
| C | 0.030 max. |
| Mn | 0.75 max. |
| Si | 0.75 max.. |
| P | 0.040 max. |
| S | 0.15–0.35 |
| Cr | 14.0–15.5 |
| Ni | 5.0–6.0 |
| Mo | 0.50–1.2 |
| Cu | 3.0–4.0 |
| Nb | 0.10–0.30 |
| B | 0.010 max. |
| N | 0.030 max. |

The balance of the alloy is iron and the usual impurities found in commercial grades of martensitic precipitation-hardening stainless steels intended for similar use or service.

20 Claims, No Drawings

FREE-MACHINING, MARTENSITIC, PRECIPITATION-HARDENABLE STAINLESS STEEL

FIELD OF THE INVENTION

This invention relates to precipitation-hardenable martensitic stainless steels and in particular to a precipitation-hardenable martensitic stainless steel that provides a unique combination of machinability, processability, and toughness.

BACKGROUND OF THE INVENTION

The known precipitation-hardenable stainless steels provide high hardness and strength through an age-hardening heat treatment in which a strengthening phase is formed in the relatively, more ductile matrix of the alloy. Such alloys have been used principally in components for aerospace applications. Another type of stainless steel that is designed to provide relatively high strength is the so-called "straight" martensitic stainless steel. An example of such a steel is AISI Type 416 alloy. Such steels achieve high strength when they are quenched from a solution or austenitizing temperature and then tempered. Although there are free-machining grades of the straight martensitic stainless steels, there has not been any known martensitic precipitation-hardenable stainless steel that could be classified as a truly "free-machining" grade. In other words, none of the known grades of precipitation-hardenable martensitic stainless steels contain more than about 0.15% of a free-machining additive such as sulfur or selenium. Because of the simplicity of heat treating the precipitation-hardenable martensitic stainless steels compared to the straight martensitic stainless steels, it would be desirable to have a precipitation-hardenable martensitic stainless steel that provides true free-machining capability.

Hitherto, attempts have been made to produce martensitic precipitation-hardenable stainless steels that provide "enhanced machinability" relative to the standard grades. Such attempts have included the use of limited amounts of free-machining additives such as sulfur or selenium. Alloys have been described that may contain up to relatively high amounts of such additives, e.g., up to 0.40 weight percent, up to 0.5 weight percent, or up to 0.15 weight percent of sulfur or selenium. However, there has not been a commercially produced precipitation-hardenable martensitic stainless steel that actually contains more than about 0.036 weight percent of sulfur or selenium.

The principal reason for the unavailability of a true free-machining precipitation-hardenable martensitic stainless steel is that the presence of the usual free-machining additives such as sulfur and selenium adversely affects important properties of the precipitation-hardenable grades of stainless steels. For example, the presence of sulfur in a known grade of precipitation-hardenable stainless steel has resulted in poor processability, such that the steel tears or splits during hot working or cracks during cold processing or quenching. Also, the presence of sulfur adversely affects the toughness and ductility of the alloy.

SUMMARY OF THE INVENTION

In accordance with the present invention, there is provided a free-machining, precipitation-hardenable martensitic stainless steel, having a unique combination of machinability, processability, and toughness. The broad, intermediate, and preferred compositional ranges of the steel alloy of the present invention are as follows, in weight percent:

| | Broad | Intermediate | Preferred |
|---|---|---|---|
| C | 0.030 max. | 0.025 max. | 0.020 max. |
| Mn | 0.75 max. | 0.50 max. | 0.50 max. |
| Si | 0.75 max. | 0.50 max. | 0.50 max. |
| P | 0.040 max. | 0.035 max. | 0.030 max. |
| S | 0.15–0.35 | 0.15–0.30 | 0.17–0.25 |
| Cr | 14.0–15.5 | 14.0–15.5 | 14.5–15.0 |
| Ni | 5.0–6.0 | 5.0–6.0 | 5.0–5.5 |
| Mo | 0.50–1.2 | 0.50–1.0 | 0.70–1.0 |
| Cu | 3.0–4.0 | 3.0–4.0 | 3.2–3.8 |
| Nb | 0.10–0.30 | 0.10–0.25 | 0.10–0.20 |
| N | 0.030 max. | 0.025 max. | 0.020 max. |
| B | 0.010 max. | 0.005 max. | 0.005 max. |

The balance of the alloy is essentially iron, except for the usual impurities found in commercial grades of martensitic, precipitation-hardenable stainless steels and trace amounts of other elements which may vary from a few thousandths of a percent up to larger amounts that do not objectionably detract from the desired combination of properties.

The foregoing tabulation is provided as a convenient summary and is not intended to restrict the lower and upper values of the ranges of the individual elements of the alloy of this invention for use in combination with each other, or to restrict the ranges of the elements for use solely in combination with each other. Thus, one or more of the element ranges of the broad composition can be used with one or more of the other ranges for the remaining elements in the preferred composition. In addition, a minimum or maximum for an element of one preferred embodiment can be used with the maximum or minimum for that element from another preferred embodiment. Throughout this application, the term "percent" or the symbol "%" means percent by weight, unless otherwise indicated.

DETAILED DESCRIPTION

The precipitation hardenable alloy according to this invention contains at least about 14.0% and preferably at least about 14.5% chromium in order to provide the desired level of corrosion resistance. Too much chromium promotes the formation of an undesirable amount of ferrite in this alloy, which adversely affects the toughness and ductility provided by the alloy. Accordingly, the alloy contains not more than about 15.5% and preferably not more than about 15.0% chromium.

Sulfur benefits the machinability of this alloy and at least about 0.15%, preferably at least about 0.17%, sulfur is present in order to obtain a significant improvement in machinability, particularly form-tool machinability. The alloy contains not more than about 0.35%, better yet not more than about 0.30%, and preferably not more than about 0.25% sulfur because too much sulfur adversely affects the processability, toughness, and the corrosion resistance of this alloy.

Nickel promotes the formation of austenite when the alloy is heated at an elevated temperature so that the alloy will readily form martensite during quenching from the elevated temperature. Nickel also contributes to corrosion resistance and toughness in this alloy. Good toughness is important not only for cold processability, but also to inhibit cracking of the alloy when it is quenched, a problem that typically arises in stainless steels containing elevated amounts of sulfur. Nickel also promotes the formation of reverted austenite during the age-hardening process. The presence of a limited amount of reverted austenite in the alloy is beneficial to the toughness of the alloy. For these reasons, the alloy according to this invention contains at least about 5.0% nickel.

Excessive nickel depresses the martensite transformation temperature, which leads to retained austenite after the alloy is quenched. The presence of retained austenite adversely affects the strength capability of the alloy. Therefore, the alloy contains not more than about 6.0% nickel and preferably not more than about 5.5% nickel.

Molybdenum contributes to the corrosion resistance of the alloy, particularly resistance to pitting-type corrosion. Molybdenum also benefits the toughness and ductility provided by this alloy. Accordingly, the alloy contains at least bout 0.50%, and preferably at least about 0.70% molybdenum. Molybdenum promotes the formation of ferrite, too much of which, as noted above, adversely affects the toughness and ductility of this alloy. Therefore, the alloy contains not more than about 1.2% and preferably not more than about 1.0% molybdenum.

At least about 3.0%, preferably at least about 3.2%, copper is present in this alloy as a precipitation hardening agent. During the age hardening heat treatment, the alloy achieves substantial strengthening through the precipitation of fine, copper-rich particles from the martensitic matrix. Too much copper adversely affects the hot workability of the alloy. Therefore, the alloy contains not more than about 4.0% and preferably not more than about 3.8% copper.

At least about 0.10% niobium is present in this alloy primarily as a stabilizing agent against the formation of chromium carbonitrides which are deleterious to the corrosion resistance of the alloy. Too much niobium causes excessive formation of niobium carbides, niobium nitrides, and/or niobium carbonitrides which adversely affect the good machinability provided by this alloy. Too many niobium carbonitrides also adversely affect the alloy's toughness. Furthermore, excessive niobium results in the formation of an undesirable amount of ferrite in this alloy. Therefore, the alloy contains not more than about 0.30%, better yet not more than about 0.25%, and preferably not more than about 0.20% niobium. Those skilled in the art will recognize that tantalum may be substituted for some of the niobium on a weight percent basis. However, tantalum is preferably restricted to not more than about 0.05% in this alloy.

A small but effective amount of boron may be present in amounts up to about 0.010%, preferably up to about 0.005%, to benefit the hot workability and toughness of this alloy.

The balance of the alloy composition is iron except for the usual impurities found in commercial grades of martensitic precipitation-hardenable stainless steels intended for similar use or service. For example, the interstitial elements carbon and nitrogen are restricted to low levels in this alloy in order to benefit the machinability and processability of the alloy, especially during cold processing and quenching. Therefore, the alloy contains not more than about 0.030%, better yet, not more than about 0.025%, and preferably not more than about 0.020% of each of carbon and nitrogen. Other elements such as manganese, silicon, and phosphorus are also maintained at low levels because they adversely affect the good toughness provided by this alloy. More specifically, this alloy contains not more than about 0.75% and preferably not more than about 0.50% manganese because manganese combines with sulfur to form manganese sulfides which adversely affect the corrosion resistance of the alloy. Silicon is typically added to provide deoxidation of the alloy during refining. However, silicon promotes the formation of ferrite in this alloy. Therefore, the alloy contains not more than about 0.75% and preferably not more than about 0.50% silicon. This alloy contains not more than about 0.040%, better yet, not more than about 0.035%, and preferably not more than about 0.030% phosphorus because it adversely affects the toughness and the machinability of this alloy.

The alloy according to this invention is preferably arc-melted in air (ARC), but can also be melted by vacuum induction melting (VIM). The alloy can be refined by vacuum arc remelting (VAR). The alloy may be produced in various product forms including billet, bar, rod, and wire. The alloy is preferably hot worked from a temperature of about 2150–2350° F. The alloy is solution treated by heating at about 1800–2000° F. for about one-half to one hour and then rapidly quenched, preferably with water. The alloy is then aged to final strength by heating at about 900–1150° F. for up to about 4 hours, followed by cooling in air. The alloy may be used to fabricate a variety of machined, corrosion resistant parts that require high strength and good toughness. Among such end products are valve parts, fittings, fasteners, shafts, gears, combustion engine parts, components for chemical processing equipment and paper mill equipment, and components for aircraft and nuclear reactors.

The unique combination of properties provided by the alloy according to the present invention will be appreciated better in the light of the following examples.

WORKING EXAMPLES

To demonstrate the unique combination of properties provided by the alloy according to the present invention, two experiments were carried out. In the first experiment, Example I, the machinability of the alloy was compared to two known commercial grades of stainless steels. In the second experiment, Example II, the impact toughness of the alloy was compared to a known precipitation- hardenable stainless steel.

Example I

For this experiment two 400 lb. heats having weight percent compositions according to the present invention were vacuum induction melted under a partial pressure of argon gas. The weight percent compositions of the two examples of the present alloy, Alloy 1 and Alloy 2, are set forth in Table 1 below together with the weight percent compositions of a commercial heat of Type 303 stainless steel, and a commercial heat of a 17Cr-4Ni precipitation-hardenable stainless steel.

TABLE 1

| Elmt./Alloy | Alloy 1 | Alloy 2 | Type 303 | 17Cr—4Ni |
|---|---|---|---|---|
| C | 0.018 | 0.020 | 0.061 | 0.025 |
| Mn | 0.30 | 0.30 | 1.74 | 0.62 |
| Si | 0.40 | 0.39 | 0.59 | 0.40 |
| P | 0.020 | 0.019 | 0.035 | 0.020 |
| S | 0.16 | 0.31 | 0.34 | 0.026 |
| Cr | 14.79 | 14.83 | 17.49 | 15.32 |
| Ni | 5.02 | 5.00 | 8.54 | 4.48 |
| Mo | 0.75 | 0.75 | 0.52 | 0.27 |
| Cu | 3.52 | 3.51 | 0.35 | 3.49 |
| Nb | 0.21 | 0.21 | 0.05 | 0.21 |
| N | 0.020 | 0.021 | 0.038 | 0.013 |
| B | 0.003 | 0.003 | — | 0.0020 |

The balance of each composition is iron and usual impurities. The Type 303 stainless steel was selected because it is a known free-machining grade of austenitic stainless steel. The 17Cr-4Ni precipitation-hardenable stainless steel was selected for the comparison because it is a known precipitation-hardenable stainless steel with enhanced machinability relative to other precipitation-hardenable stainless grades.

Alloys 1 and 2 were cast as 7½ inch square ingots. After solidification, the ingots were forged to 4 inch square billets from a temperature of 2300° F. The forged billets were then aged by heating at 620° C. for 4 hours and then cooled in air. The aged billets were then cogged to 2.125 inch round bars from a temperature of 2000° F. and hot rolled to 0.6875 inch round from a temperature of 2300° F. The 0.6875 inch bars of each heat were then solution annealed by heating at a temperature of 1040° C. for 1 hour and then water quenched. The annealed bars were straightened, turned to 0.637 inch round, restraightened, and then surface ground to 0.625 inch round. Inspection of the bars revealed a single isolated surface crack in one bar of the lower-sulfur heat, Alloy 1. No such problems were encountered with the higher sulfur heat, Alloy 2. Those results indicate a low and acceptable propensity for cracking during cold processing and quenching from the annealing temperature.

The 17Cr-4Ni material was obtained as 10 inch x 8 inch continuously cast billet which was hot rolled to 0.6875 inch round bar from 1950° F. The bar material was aged at 620° C. for 4 hours and then cooled in air. It was then solution annealed at 1040° C. for 1 hour and quenched in water. The bar material was then straightened, cut, and further processed to 0.625 inch round.

The Type 303 material was obtained as coiled rod which was hot rolled and then quenched in water from the hot rolling temperature. The resulting bar was shaved and then cold drawn to 0.625 inch round.

The machinability of each alloy was evaluated on an automatic screw machine. Two sets of tests were conducted. The first compared the machinability of Alloy 1 to the sample of the 17Cr-4Ni precipitation-hardenable stainless steel. The second test compared the machinability of Alloys 1 and 2 to the Type 303 austenitic stainless steel.

In the first machinability test, duplicate tests were conducted on the 0.625 inch round bars of Alloy 1 and the 17Cr-4Ni precipitation-hardenable stainless steel. A form tool was used to machine the bars of each composition to provide parts having a contoured surface. This test was conducted with a spindle speed of 150.6 surface feet per minute (SFM) and a tool feed rate of 0.002 inches per revolution (ipr). A given trial was terminated for one of two reasons (i) growth of the part diameter exceeding 0.003" as a result of tool wear or (ii) at least 300 parts were machined without exceeding 0.003" part growth. Tool failure, a third reason for test termination, was not experienced in this testing. The results of the first machinability test are set forth in Table 2 below, including the number of parts machined (Parts Machined) and the amount of growth in the diameter of the machined parts when the test was terminated (Part Growth).

TABLE 2

| Alloy | Parts Machined | Part Growth |
|---|---|---|
| Alloy 1 | 300 | 0.0002 in. |
| | 300 | 0.0004 in. |
| 17Cr—4Ni | 90 | 0.0037 in. |
| | 80 | 0.0044 in. |

In the second machinability test, duplicate tests were conducted on the 0.625 inch round bars of Alloys 1 and 2 and the Type 303 stainless steel. As in the first test, a form tool was used to machine the bars of each composition to provide parts having a contoured surface. This test was conducted at a spindle speed of 178.5 SFM and a feed rate of 0.002 ipr. A given trial was terminated for one of the following reasons: (i) growth of the part diameter exceeding 0.003" as a result of tool wear, (ii) at least 300 parts were machined without the 0.003" part growth, or (iii) tool failure. The results of the second machinability test are set forth in Table 3 below, including the number of parts machined (Parts Machined).

TABLE 3

| Alloy | Parts Machined |
|---|---|
| 1 | 240 |
| | 250 |
| 2 | 400 |
| | 470 |
| Type 303 | 330 |
| | 270 |

The data presented in Table 2 show that the precipitation-hardenable stainless steel according to this invention provides clearly superior machinability relative to the enhanced-machinability grade of precipitation-hardenable stainless steel. In addition, the data of Table 3 show that the alloy of this invention provides machinability that is comparable to that of Type 303 alloy. Thus, the alloy of this invention can be readily used in place of that alloy for those applications requiring higher strength, without sacrificing machinability or corrosion resistance.

Example II

For this experiment four small heats having the weight percent compositions set forth in Table 4 below were vacuum induction melted under a partial pressure of argon gas. Alloys 3–5 are examples of the alloy according to the present invention. Heat A is a comparative composition of a known precipitation-hardenable stainless steel alloy.

TABLE 4

| Elmt./Alloy | Alloy 3 | Alloy 4 | Alloy 5 | Heat A |
|---|---|---|---|---|
| C | 0.019 | 0.020 | 0.018 | 0.014 |
| Mn | 0.49 | 0.49 | 0.50 | 0.49 |
| Si | 0.43 | 0.43 | 0.44 | 0.44 |
| P | 0.022 | 0.024 | 0.022 | 0.023 |
| S | 0.15 | 0.16 | 0.15 | 0.024 |
| Cr | 15.51 | 15.51 | 15.02 | 15.49 |
| Ni | 5.03 | 5.06 | 5.04 | 4.86 |
| Mo | 0.51 | 0.71 | 0.71 | 0.27 |
| Cu | 3.15 | 3.14 | 3.21 | 3.16 |
| Nb | 0.20 | 0.20 | 0.19 | 0.18 |
| N | 0.014 | 0.014 | 0.013 | 0.011 |
| B | 0.002 | 0.0025 | 0.003 | 0.002 |

The balance of each composition is iron and usual impurities.

Each of the heats was cast as a 2¾ inch ingot. The ingot of each heat was heated at 2300° F. for 2 hours and then press forged to 13/4 inch square bar. The bar was reheated to 2300° F. and press forged to 1⅛ inch square bar. Standard 0.394 inch square Charpy V-notch (CVN) specimens were prepared from the 11/g inch square bars as follows. The bar was solution treated at 1900° F. for 1 hour and then quenched in water. The as-quenched bar material was then machined to form the CVN specimens. The specimens were then aged at 900° F. for 4 hours and then cooled in air.

Four impact specimens from each heat were tested in accordance with ASTM E 23. The results of the impact testing are presented in Table 5 below including the impact strength (IMPACT STRENGTH) in foot-pounds (ft-lbs). The four individual readings (1, 2, 3, 4) and the average (Average) of the four readings are presented.

TABLE 5

| | IMPACT STRENGTH (ft-lbs) | | | | |
|---|---|---|---|---|---|
| | 1 | 2 | 3 | 4 | Average |
| Alloy 3 | 12.25 | 14.5 | 14.25 | 14.0 | 13.8 |
| Alloy 4 | 11.5 | 13.25 | 14.25 | 14.5 | 13.4 |
| Alloy 5 | 12.0 | 11.75 | 12.5 | 12.5 | 12.2 |
| Heat A | 7.5 | 5.75 | 4.75 | 6.5 | 6.1 |

The data in Table 5 show that the alloy according to the present invention does not have reduced impact toughness compared to the known alloy, even though the alloy of this invention contains significantly more sulfur than the known alloy.

The terms and expressions that have been employed herein are used as terms of description and not of limitation. There is no intention in the use of such terms and expressions to exclude any equivalents of the features described or any portions thereof. It is recognized, however, that various modifications are possible within the scope of the invention claimed.

What is claimed is:

1. A precipitation-hardenable, martensitic stainless steel alloy, consisting essentially of, in weight percent, about

| | |
|---|---|
| C | 0.030 max. |
| Mn | 0.75 max. |
| Si | 0.75 max.. |
| P | 0.040 max. |
| S | 0.15–0.35 |
| Cr | 14.0–15.5 |
| Ni | 5.0–6.0 |
| Mo | 0.50–1.2 |
| Cu | 3.0–4.0 |
| Nb | 0.10–0.30 |
| B | 0.010 max. |
| N | 0.030 max. |

and the balance is essentially iron and the usual impurities.

2. A precipitation-hardenable, martensitic stainless steel alloy as set forth in claim 1 which contains at least about 0.70% molybdenum.

3. A precipitation-hardenable, martensitic stainless steel alloy as set forth in claim 1 which contains at least about 3.2% copper.

4. A precipitation-hardenable, martensitic stainless steel alloy as set forth in claim 1 which contains not more than about 0.25% niobium.

5. A precipitation-hardenable, martensitic stainless steel alloy as set forth in claim 1 which contains not more than about 0.30% sulfur.

6. A precipitation-hardenable, martensitic stainless steel alloy as set forth in claim 1 which contains not more than about 1.0% molybdenum.

7. A precipitation-hardenable, martensitic stainless steel alloy as set forth in claim 1 which contains not more than about 15.0% chromium.

8. A precipitation-hardenable, martensitic stainless steel alloy as set forth in claim 1 which contains not more than about 0.025% carbon and not more than about 0.025% nitrogen.

9. A precipitation-hardenable, martensitic stainless steel alloy as set forth in claim 1 which contains not more than about 0.50% manganese and not more than about 0.50% silicon.

10. A precipitation-hardenable, martensitic stainless steel alloy as set forth in claim 1 which contains at least about 0.17% sulfur.

11. A precipitation-hardenable, martensitic stainless steel alloy, consisting essentially of, in weight percent, about

| | |
|---|---|
| C | 0.025 max. |
| Mn | 0.50 max. |
| Si | 0.50 max. |
| P | 0.035 max. |
| S | 0.15–0.30 |
| Cr | 14.0–15.5 |
| Ni | 5.0–6.0 |
| Mo | 0.50–1.0 |
| Cu | 3.0–4.0 |
| Nb | 0.10–0.25 |
| B | 0.005 max. |
| N | 0.025 max. |

and the balance is essentially iron and the usual impurities.

12. A precipitation-hardenable, martensitic stainless steel alloy as set forth in claim 11 which contains at least about 0.70% molybdenum.

13. A precipitation-hardenable, martensitic stainless steel alloy as set forth in claim 11 which contains at least about 3.2% copper.

14. A precipitation-hardenable, martensitic stainless steel alloy as set forth in claim 11 which contains not more than about 0.20% niobium.

15. A precipitation-hardenable, martensitic stainless steel alloy as set forth in claim 11 which contains not more than about 0.25% sulfur.

16. A precipitation-hardenable, martensitic stainless steel alloy as set forth in claim 11 which contains not more than about 15.0% chromium.

17. A precipitation-hardenable, martensitic stainless steel alloy as set forth in claim 11 which contains not more than about 0.020% carbon and not more than about 0.020% nitrogen.

18. A precipitation-hardenable, martensitic stainless steel alloy as set forth in claim 11 which contains not more than about 3.8% copper.

19. A precipitation-hardenable, martensitic stainless steel alloy as set forth in claim 11 which contains at least about 0.17% sulfur.

20. A precipitation- hardenable, martensitic stainless steel alloy, consisting essentially of, in weight percent, about

| | |
|---|---|
| C | 0.020 max. |
| Mn | 0.50 max. |
| Si | 0.50 max. |
| P | 0.030 max. |
| S | 0.17–0.25 |
| Cr | 14.5–15.0 |
| Ni | 5.0–5.5 |
| Mo | 0.70–1.0 |
| Cu | 3.2–3.8 |
| Nb | 0.10–0.20 |
| B | 0.005 max. |
| N | 0.020 max. |

and the balance is essentially iron and the usual impurities.

* * * * *